United States Patent [19]

Ayer

[11] Patent Number: 4,898,550

[45] Date of Patent: Feb. 6, 1990

[54] EXTRUDED PLASTIC HINGE COVER FOR TERMINAL BLOCKS

[75] Inventor: George E. Ayer, Naperville, Ill.

[73] Assignee: Reliance Comm/Tec Corporation, Franklin Park, Ill.

[21] Appl. No.: 382,003

[22] Filed: Jul. 17, 1989

Related U.S. Application Data

[63] Continuation of Ser. No. 139,001, Dec. 29, 1987, abandoned.

[51] Int. Cl.[4] ..... H01R 9/00

[52] U.S. Cl. ..... 439/718

[58] Field of Search ..... 439/135, 136, 142, 709, 439/713, 718, 719; 16/225

[56] References Cited

U.S. PATENT DOCUMENTS

| | | | |
|---|---|---|---|
| 3,247,480 | 4/1966 | Orzechowski | 439/718 |
| 3,836,826 | 9/1974 | Hotchkiss et al. | 439/718 |
| 3,957,335 | 5/1976 | Troy | 339/125 R |
| 3,966,074 | 6/1976 | Hotchkiss et al. | 439/718 |
| 4,180,305 | 12/1979 | Ustin et al. | 439/718 |
| 4,550,964 | 11/1985 | Donais et al. | 439/142 |
| 4,563,381 | 1/1986 | Woodland | 16/225 |

*Primary Examiner*—Joseph H. McGlynn

*Attorney, Agent, or Firm*—R. A. Blackstone, Jr.

[57] ABSTRACT

A snap-on hinge cover for a communications terminal block comprising an extruded plastic body having three longitudinally extending sections, the three sections being joined along longitudinally extending boundary regions to constitute a unitary structure. The outer longitudinal margins of the unitary structure having structure for snap-fitting onto the fanning strips of terminal block. Longitudinally hinge means is at one of said boundary regions. The hinge means is extruded along with components of plastic of the rest of the body, the hinge means having a resiliency which is high as compared to the resiliency of said body and constituting a memory which biases the hinged portion of the cover to an open position.

11 Claims, 2 Drawing Sheets

EXTRUDED PLASTIC HINGE COVER FOR TERMINAL BLOCKS

This application is a continuation, division, of application Ser. No. 139,001, filed Dec. 29, 1987, now abandoned.

BACKGROUND OF THE INVENTION

This invention relates generally to new and useful improvements in a cover of a type that fits onto a terminal block, the latter having terminated communication wires therein.

The terminal blocks with which the present invention is concerned and in connection with which the novel cover has been developed is of the type that is usually formed of a molded plastic body having a number of rows of holes into which electrical terminals are mounted. The terminals are electrically insulated from one another to permit wire termination of incoming and outgoing wires with which the terminal block is used. The terminal block is furthermore formed along its opposed longitudinal margins with fanning strips which fan out the wires that lead to and from the terminals within the block.

It is desireable that the terminals within the block be protected against damage, and for this reason various attempts have been made to provide protective covers. These attempts have included covers which are difficult to install and remove except by destruction of the cover. Furthermore, the cover is normally injection molded and this factor tends to make the costs of parts high.

OBJECTS AND SUMMARY OF THE INVENTION

Accordingly an object of the present invention is to provide a snap-on hinge cover for a communications terminal block that is an extruded plastic part and is an inexpensive item to produce. The extrusion technique permits the use of two plastic materials in which one of the plastic materials is more resilient than the other, i.e. one of the materials is for the main body of the cover and the other material if for the cover hinge. Thus the resilient hinge material offers a longer lasting hinge action as well as facilitating latching of the cover in place or biasing the cover to its full open position.

It is further object of this invention to provide a hinge cover of the type stated which is extruded rather than injection molded, and is therefore less expensive to produce.

It is a more specific object of this invention to provide a snap-on hinge cover of the type stated in which the two plastic materials are of the same general type but differ in hardness and resiliency. The hinge area or areas are extruded with the two side by side layers which become interally laminated in place during the extrusion process.

It is another object of this invention to provide a hinge cover of the type stated in which the cover is designed for easy installation and removal onto the terminal block without damage to terminals thereon.

It is a further object of this invention to provide a hinge cover of the type stated in which the hinge has a "memory" therein brought about as a result of the extrusion. This results in the hinge portion of the cover being biased outwardly and away from the block upon which the cover is mounted so as to facilitate access to the block by service personnel.

Accordingly, the cover comprises a plastic body having first, second, and third longitudinally extending sections, the second section being laterally intermediate the first and third sections, the three sections being joined along boundary regions, said first and third sections having marginal regions spaced from said boundary regions, means at said marginal regions for snap-fitting said body onto opposed longitudinally spaced fanning strips of a communications terminal block, longitudinally extending hinge means at one of said boundary regions, said hinge being formed as an extruded strip along with the extrusion of adjacent components of plastic of said body and with said body being of a predetermined rigidity, said components having spaced adjacent edges forming a gap and said hinge-forming extruded strip spanning said gap and having a resiliency which is high as compared to resiliency of said body and constituting a memory which biases the hinge portion of the cover to a pre-determined position.

In particular, resiliency of the hinge forming strip biases the hinge portion of the cover to an open position which is approximately 90 degrees from the closed position. Furthermore, in the closed position the hinged portion of the cover engages the fanning strip by reason of the memory introduced into the extrusion, which is molded in the "cover open" position.

DETAILED DESCRIPTION

Figure 1:
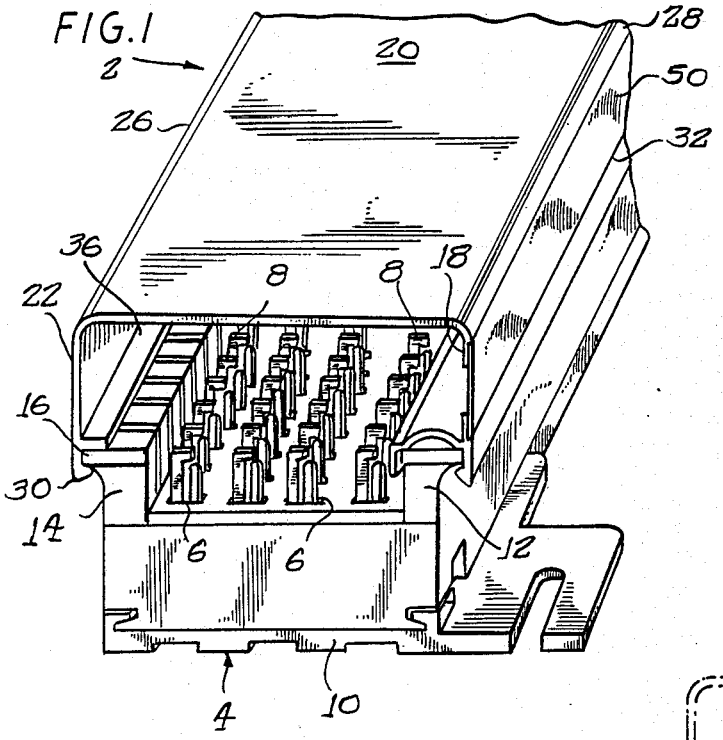
FIG. 1 is a fragmentary perspective view of a snap-on hinge cover constructed in accordance with and embodying the present invention and being shown mounted on a communications terminal block.

Referring now in more detail to the drawing, which illustrates a preferred embodiment of the present invention, 2 designates a one piece plastic hinge cover for a communications terminal block of generally conventional design. Suffice it to say that the terminal block 4 has an elongated plastic body 4 and is molded with a plurality of holes 6 which are in a series of rows, and which are adapted to receive a series of electrical terminals 8. The terminals 8 are held within the block by a retaining plate 10 which makes a sliding tongue and groove connection with the main body portion of the block 4.

The terminals 8 are preferably of the multiple beam clip type in which a wire is inserted between the adjacent beams of the clip, and the insulation is sheared off of the wires by knife edges on the beam to establish contact with the wire. Such clip type terminals are known in the art and are shown, for example, in U.S. Pat. No. to Ayer 3,887,259.

The block 4 is also molded with fanning strips 12, 14 along opposite longitudinal margins. These fanning strips accomodate the wires which are connected to the terminals 8 and "fan out" therefrom. Generally speaking, the fanning strips in 14 are formed with a plurality of outwardly extremely posts having enlarged head portions 16.

The cover 2 is formed of extruded polyvinylchloride, a known and commercially available resinous material. The plastic body of the cover has first, second, and third longitudinally extending sections 18, 20, 22, the three sections being joined along boundary regions 26, 28. The first and third sections 18, 22 have marginal regions 30, 32 at which are formed means for snap-fitting engagement of the cover 2 onto the fanning strips 12, 14 in overlying relationship to terminals 8.

Figure 3:
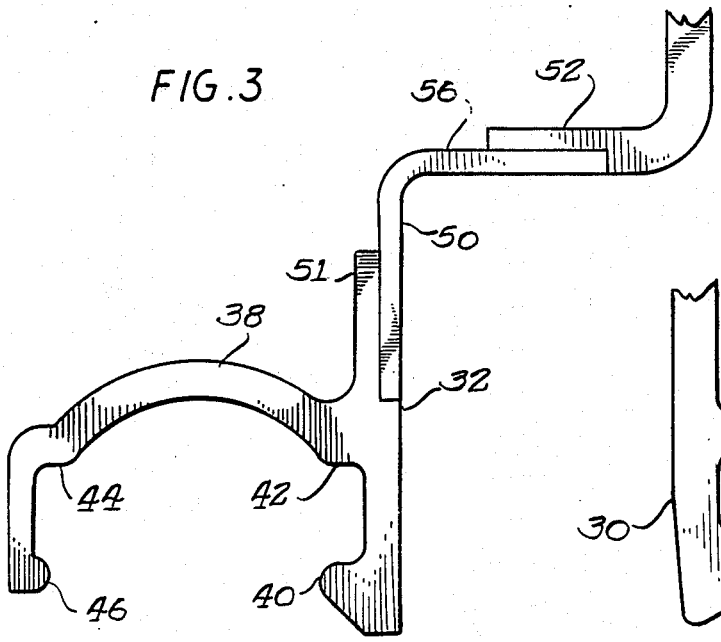
FIG. 3 is an enlarged sectional view of a portion of FIG. 1 and with the hinge portion of the cover being shown projecting upwardly in accordance with its normally molded position.
Figure 4:
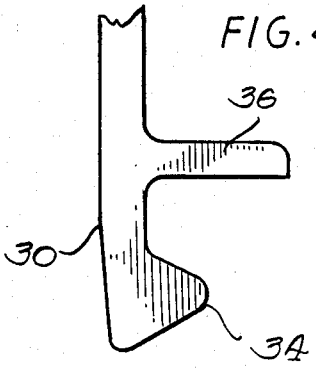
FIG. 4 is a fragmentary enlarged view of a portion of FIG. 2 at the lower left hand corner thereof.
Figure 5:
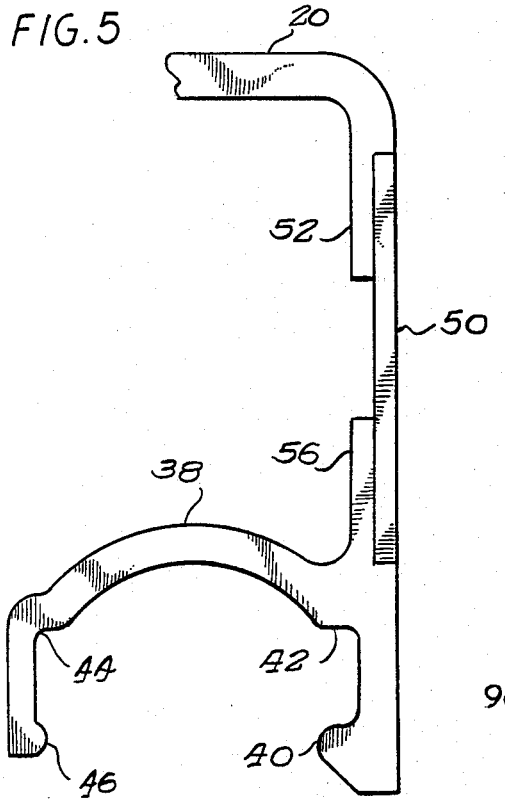
FIG. 5 is an enlarged fragmentary sectional view showing the hinged portion of the cover in the closed position.

The snap-on means at the margin 30 comprises a resilient hook 34 (FIG. 4) which cooperates with a flange 36 to retain the nose of the hook 34 underlying the enlarged head portion 16 of the fanning strip. At the margin 32 the cover is formed with a member 38 (FIG. 3) having a hook 40 and an opposing shoulder 42. Opposite to the hook and shoulder arrangement and spaced therefrom is an additional shoulder 44 and the companion bead 46. The shoulder 44 and its associated bead together with the hook 40 and its associated shoulder 42 cooperate to retain the member 38 in a snap-fitting relationship with the fanning strip.

Figure 2:
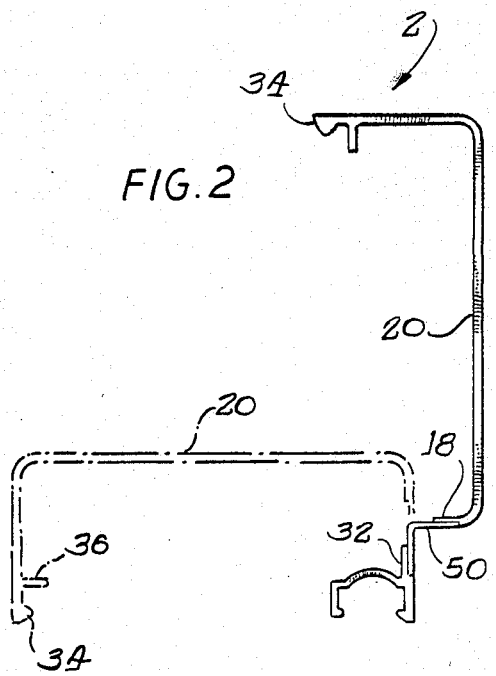
FIG. 2 is a front elevational view of the arrangement of FIG. 1 and showing the hinge portion of the cover in two alternate positions, namely, open and closed.

As previously stated, the cover is extruded as a one piece member. For this purpose the cover is extruded in the "cover open" position shown in the full lines in FIG. 2. The cover is comprised of two portions of rigid plastic material and being joined by a hinge-forming strip 50. This hinge forming strip 50 therefore joins the adjacent hinge cover components 52, 54 (FIG. 3), spanning the gap 56 there between.

The material of the hinge strip is also formed of a polyvinylchloride resin but with somewhat different properties than that of the resin used for the remainder of the cover. The cover is formed of a type 8700A extrusion PVC. Such a material has a Rockwell R hardness of about 111. The hinge strip 50 is formed of a type 83718 extrusion compound and has a Shore hardness of about 63 to 75. Both types of plastics, namely the 8700A and the 83718 are sold under the trademark GEON and are commercially available from the B.F. Goodrich Company, Akron, Ohio, U.S.A. In extruding the cover as showing full lines in FIG. 2, there is imparted into the strip 50 a memory or resiliency. Therefore, when the cover is swung down to its closed position, which is about 90 degrees from its open position, the spring potential of the strip 50 will energize so that when the structure at the margin 30 snaps past the fanning strip and releases, the cover will be retained in a locked position under a spring pressure. Likewise, when access is desired to the terminal block, release of the clip 34 (FIGS. 2 and 3) from the fanning strip will allow the cover to spring outwardly from the broken line position shown in FIG. 3 to a full line position shown in FIG. 2 where it will remain so as not to obstruct access to the wire connections terminals in the block. It has been found that the desired resiliency or memory present in the hinge strip 50, results when the extruding compound has a Shore hardness of about 63 to 75.

Figure 6:
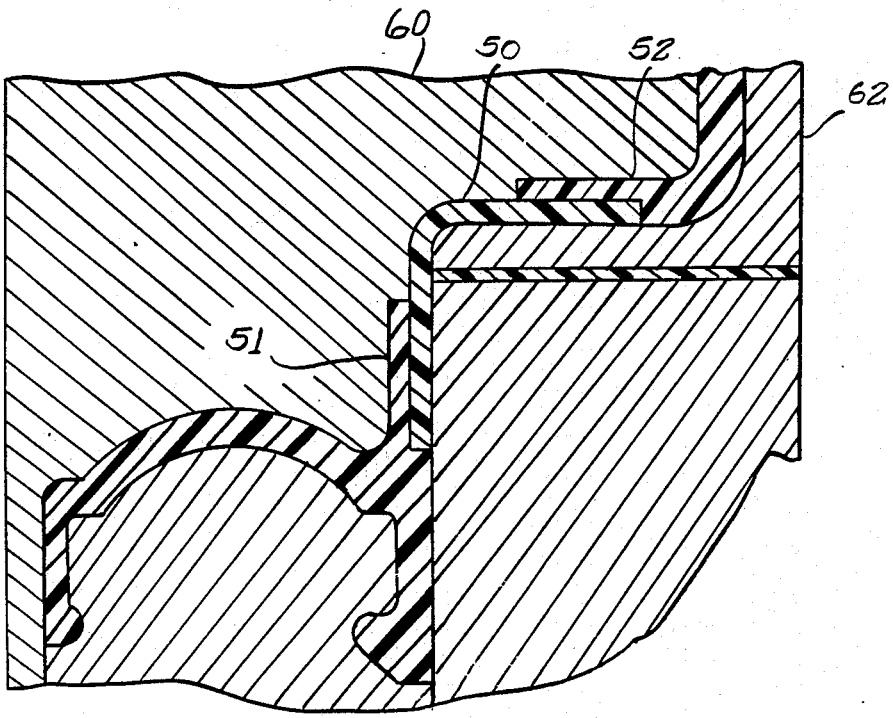
FIG. 6 is a perspective view partially in diagram form and showing the extrusion which forms part of the present invention.

Extrusion is carried out by the extrusion dies which are conventional, as shown in FIG. 6. The two types of extrusion materials are pressed into the dies 60, 62 and the hinge strip 50 is formed and is pressure laminated onto the adjacent components 54, 52 of the more rigid plastic.

Figure 7:
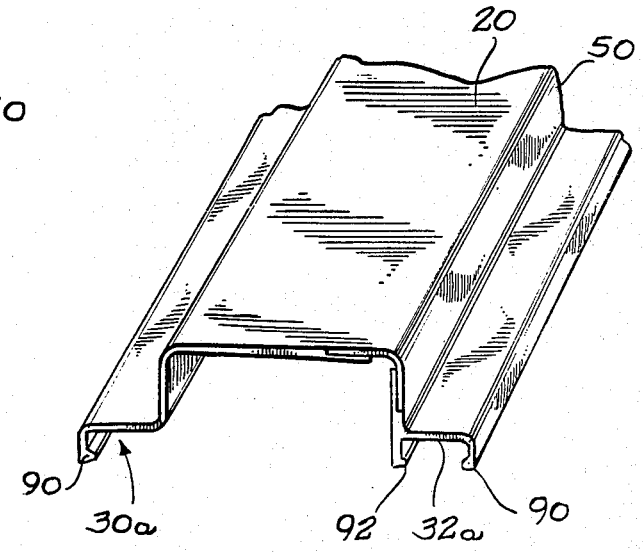
FIG. 7 is a fragmentary perspective view of a modified form of cover.

In modified form, the cover **2*a* is shown in FIG. 7. Here the marginal gripper portions 30*a*, 32*a* are configured so that these grippers 30*a*, 32*a* lie outside of the main body of the cover rather than inside as in FIGS. 1–6. Both grippers in FIG. 7 have hooks or nibs 90, 92** which serve to retain the cover in place. Other parts remain the same.

The invention is claimed as follows:

1. A snap-on hinge cover for a communications terminal block comprising a plastic body having first, second, and third longitudinally extending sections, the second section being laterally intermediate the first and third sections, and joined thereto along boundary regions, said first and third sections having marginal regions spaced from said boundary regions, means at said marginal regions for snap-fitting and releasably locking said body onto opposed longitudinally spaced fanning strips of a communications terminal block, longitudinally extending hinge means along one side of said second section connecting adjacent marginal and boundary regions, said hinge means being formed as an extruded strip along with the extrusion of adjacent components of plastic of said body and with said body being of a predetermined rigidity, said components having spaced adjacent edges forming a gap and said hinge-forming extruded strip spanning said gap and having a resiliency which is high as compared to the resiliency of said first, second, and third sections and constituting a memory which biases the hinge portion of the cover to an open position upon release of the snap-fitting engagement of the marginal region and fanning strip remote from the hinge means and with maintenance of the snap-fitting engagement of the remote marginal region and fanning strip under spring pressure of the hinge means with the cover in closed position.

2. A snap-on hinge cover according to claim 1 in which the plastic of the body has a Rockwell R hardness of about 111, and the hinge forming strip has a Shore hardness of about 63 to 75.

3. A snap-on cover according to claim 1 in which the resiliency of the hinge forming strip biases the hinge portion of the cover to an open position which is approximately 90 degrees from the closed position.

4. In combination, a terminal block having a body with a plurality of rows of openings that receive electrical terminal clips and with said clips having means for termination of wires, said body also having fanning strips on opposite sides of said clips and through which at least some of the terminated wires pass, and a protective cover for said clips, said cover having opposed margins with means interengaging said fanning strips to retain the cover onto the block, and hinge forming spring means on said cover for opening the cover to gain access to said clip terminals, said spring means having a memory in the form of resiliency that biases the cover to an open position that facilitates access to the clip terminals, and also serves to bias the cover such that the cover will be retained in a locked position under the pressure of said spring in the closed position of the cover.

5. A combination according to claim 4 in which the hinge is in the form of a strip of extruded plastic that joins two sections of the cover.

6. A combination according to claim 4 in which the cover has open and closed positions 90 degrees apart.

7. A snap-on hinge cover according to claim 1 in which said first and third sections form side walls depending from said second section with one of said side walls including the hinge means providing pivoting of the cover between the adjacent boundary and marginal regions.

8. A snap-on hinge cover according to claim 1 in which the hinge means provides pivoting of the cover along the boundary region between the second and third sections.

9. A snap-on hinge cover according to claim 1 in which said first and third sections form side walls depending from said second section with one of said side walls including the hinge means above the marginal region thereof, and said marginal region having a support member extending laterally of the hinge means and carrying spaced depending hook and shoulder means providing the fanning strip snap-fitting engaging means.

10. A snap-on hinge cover according to claim 9 in which said support member extends laterally inwardly of the hinge means and is arcuate in shape to support the hook and shoulder means therefrom.

11. A snap-on hinge cover according to claim 9 in which said support member extends laterally outwardly beyond the hinge means located along the boundary region with the second section.

* * * * *